US007836531B2

(12) United States Patent
Girard et al.

(10) Patent No.: US 7,836,531 B2
(45) Date of Patent: Nov. 23, 2010

(54) CPR DROP MECHANISM FOR A HOSPITAL BED

(75) Inventors: Jean-Francois Girard, Québec (CA); Jean Bizouard, Québec (CA); Marco Morin, Breakeyville (CA)

(73) Assignee: Stryker Corporation, Kalamazoo, MI (US)

( * ) Notice: Subject to any disclaimer, the term of this patent is extended or adjusted under 35 U.S.C. 154(b) by 174 days.

(21) Appl. No.: 12/184,740

(22) Filed: Aug. 1, 2008

(65) Prior Publication Data

US 2009/0031498 A1 Feb. 5, 2009

Related U.S. Application Data

(60) Provisional application No. 60/953,357, filed on Aug. 1, 2007.

(51) Int. Cl.
*A47B 7/02* (2006.01)

(52) U.S. Cl. ..... 5/617; 5/600; 5/616

(58) Field of Classification Search ..... 5/600, 5/617, 616

See application file for complete search history.

(56) References Cited

U.S. PATENT DOCUMENTS

| | | | |
|---|---|---|---|
| 4,346,487 | A | 8/1982 | Holdt et al. |
| 4,435,862 | A | 3/1984 | King et al. |
| 4,559,655 | A | 12/1985 | Peck |
| 4,751,754 | A | 6/1988 | Bailey et al. |
| 4,953,243 | A | 9/1990 | Birkmann |
| 5,129,116 | A | 7/1992 | Borders et al. |
| 5,329,657 | A | 7/1994 | Bartley et al. |
| 5,423,097 | A | 6/1995 | Brule et al. |
| 5,444,880 | A | 8/1995 | Weismiller et al. |
| 5,996,151 | A | 12/1999 | Bartow et al. |
| 6,000,076 | A | 12/1999 | Webster et al. |
| 6,226,816 | B1 | 5/2001 | Webster et al. |
| 6,336,235 | B1 | 1/2002 | Ruehl |
| 6,487,735 | B1 | 12/2002 | Jacques, II et al. |
| 6,566,833 | B2 | 5/2003 | Bartlett |
| 6,671,905 | B2 | 1/2004 | Bartlett et al. |

(Continued)

FOREIGN PATENT DOCUMENTS

GB 2146241 4/1985

OTHER PUBLICATIONS

Linak LA34 Actuator Product Data Sheet, copyright Jun. 2003.

*Primary Examiner*—Robert G Santos
*Assistant Examiner*—Brittany M Wilson
(74) *Attorney, Agent, or Firm*—Van Dyke, Gardner, Linn & Burkhart, LLP

(57) ABSTRACT

A patient support apparatus, such as a bed, stretcher, or the like, includes a support deck having a plurality of pivotable sections adapted to support a patient thereon. A head section of the support deck generally supports a patient's torso and is movable between a generally horizontal orientation and a raised orientation. A CPR drop assembly allows the head section to be pivoted relatively quickly to the horizontal orientation in order to allow CPR (cardiopulmonary resuscitation) to be administered to the patient. The drop assembly may include a foot pedal having both a mechanical and electrical link to an actuator. The drop assembly may also be configured to operate in different manners depending upon the angular orientation of the head section at the time the drop assembly is initially activated.

29 Claims, 14 Drawing Sheets

U.S. PATENT DOCUMENTS

| | | | | |
|---|---|---|---|---|
| 6,691,346 | B2 | 2/2004 | Osborne et al. | |
| 6,978,500 | B2 | 12/2005 | Osborne et al. | |
| 7,055,195 | B2 | 6/2006 | Roussy | |
| 2002/0148044 | A1 | 10/2002 | Hayes et al. | |
| 2005/0235418 | A1 | 10/2005 | Jacques et al. | |
| 2006/0085914 | A1 | 4/2006 | Peterson et al. | |
| 2009/0313758 | A1* | 12/2009 | Menkedick et al. | 5/618 |

* cited by examiner

CPR DROP MECHANISM FOR A HOSPITAL BED

CROSS-REFERENCE TO RELATED APPLICATIONS

This application claims priority to U.S. provisional application Ser. No. 60/953,357, filed Aug. 1, 2007 by Jean-Francois Girard et al. and entitled CPR DROP MECHANISM FOR A HOSPITAL BED, the complete disclosure of which is incorporated by reference herein.

BACKGROUND OF THE INVENTION

The present invention relates to patient support apparatuses, such as hospital beds or stretchers, that include a head section pivotable between a generally horizontal orientation and a raised orientation, and more particularly, the present invention relates to patient support apparatuses that are configured to allow the head section to pivot to the horizontal orientation quickly in an emergency situation, such as when CPR is desired to be administered to a patient on the bed.

Patient support apparatuses are often designed and built so that they can be adjusted to a variety of different orientations. In one orientation, the surface of the bed is generally flat, and the patient lies horizontally on his or her back or stomach. In another orientation, the surface of the bed is pivoted upwardly in the area of the patient's torso so that the patient sits up, either partially or wholly. In other orientations, the portion of the bed underneath the patient's legs and seat area may be pivoted to a variety of different angles. The different orientations of the bed may be selected for a variety of different reasons, including patient comfort, treatment, therapy, cleaning, and other reasons.

Regardless of the reasons for pivoting the sections of the bed to different orientations, it is desirable to quickly lower the head section of the bed to a flat orientation in an emergency situation requiring CPR. Because CPR requires compression of a patient's chest, it is more easily and effectively accomplished while the patient's torso is lying flat, rather than tilted upwardly at an angle. Further, because time is of the essence in emergency CPR situations, it is desirable for the bed to be easily and promptly adjusted so that the patient's torso moves quickly to the horizontal orientation.

SUMMARY OF THE INVENTION

The present invention provides an emergency CPR drop mechanism for a patient support structure, such as a bed or stretcher, which may be used in a healthcare setting, such as a hospital, a nursing home, or other similar environment. The emergency CPR drop mechanism of the present invention allows for the quick lowering of a patient's torso in a manner that frees up the hands of a health care provider so that he or she can use his or her hands to perform other tasks during the time the patient's torso is being lowered. The emergency CPR drop mechanism of the present invention is also immune to electrical power failures so that a patient's torso can be quickly lowered to a flat orientation even in the absence of electrical power. The present invention thereby provides a robust and simple-to-use mechanism for rapidly lowering the head section of a patient support apparatus in an emergency situation.

According to one aspect of the present invention, a patient support apparatus is provided that includes a base, a frame, an elevation mechanism, and a patient support deck adapted to support a patient. The elevation mechanism is adapted to raise and lower the frame with respect to the base and the patient support deck is mounted to the frame. The patient support deck includes a pivotable head section that pivots about a horizontal pivot axis oriented generally perpendicular to a direction extending from a head end of the support apparatus to a foot end of the support apparatus. The head section is pivotable between a generally horizontal orientation and a raised orientation. An actuator having an electrical motor is coupled to the frame and pivots the head section about the pivot axis. The actuator is in electrical communication with a controller. A foot pedal is coupled to the base and moveable between a first position and a second position. An electrical link between the foot pedal and the controller is provided wherein the electrical link communicates an activation signal to the controller when the foot pedal moves from the first position to the second position. A mechanical link is also provided between the foot pedal and the actuator, and the mechanical link communicates mechanical motion to the actuator when the foot pedal moves from the first position to the second position.

According to another aspect of the present invention, a patient support apparatus is provided having a patient support deck adapted to support a patient. The patient support deck includes a pivotable head section adapted to pivot about a horizontal pivot axis oriented generally perpendicular to a direction extending from a head end to a foot end of the patient support apparatus. The head section is pivotable between a generally horizontal orientation and a raised orientation. A motorized actuator is provided that pivots the head section about the pivot axis. A sensor detects the angular orientation of the head section with respect to a known reference, such as a horizontal plane. A first user-activated control is provided that drives the motor such that the head section pivots toward the generally horizontal orientation at a first rate dictated by a speed of the actuator motor, and a second user-activated control is provided that allows the head section to pivot from an initial orientation toward the generally horizontal orientation at a second rate faster than the first rate. A controller is in communication with the sensor and adapted to drive the motor. The second user-activated control causes the controller to drive the motor only if the sensor detects the angular orientation of the head section is greater than a predetermined threshold.

According to another aspect of the present invention, an emergency drop assembly for a patient support apparatus adapted to pivot a head section of a patient support deck about a pivot axis from an initial non-horizontal orientation to a generally horizontal orientation is provided. The assembly includes a sensor, an actuator, a user-activated control, and a controller. The sensor is adapted to detect an angular orientation of the head section with respect to a horizontal plane. The actuator pivots the head section about the pivot axis and includes a motor. The user-activated control is adapted to be activated by a user. The controller is in communication with the sensor, the motor, and the user-activated control, and the controller is adapted to allow the pivoting of the head section from the initial non-horizontal orientation to the generally horizontal orientation in a first manner if the angular orientation detected by the sensor meets a first criteria and in a second manner if the angular orientation detected by the sensor does not meet the first criteria. The first manner is different from the second manner.

According to various other aspects of the present invention, the actuator may include a release on it that is triggered by the mechanical link. The triggering of the release allows a variable length member of the actuator to move at a rate faster than a rate dictated by the motor inside the actuator. The threshold angle may be set at a value of twenty degrees, although the threshold angle may vary anywhere from fifteen to seventy degrees, and even beyond. The mechanical link may be a Bowden cable, and the patient support apparatus may include one or more user-activated controls in addition to the emergency CPR drop mechanism controls. Such other controls may be used to reorient the various bed sections during non-emergency situations.

DETAILED DESCRIPTION OF THE INVENTION

Figure 1:
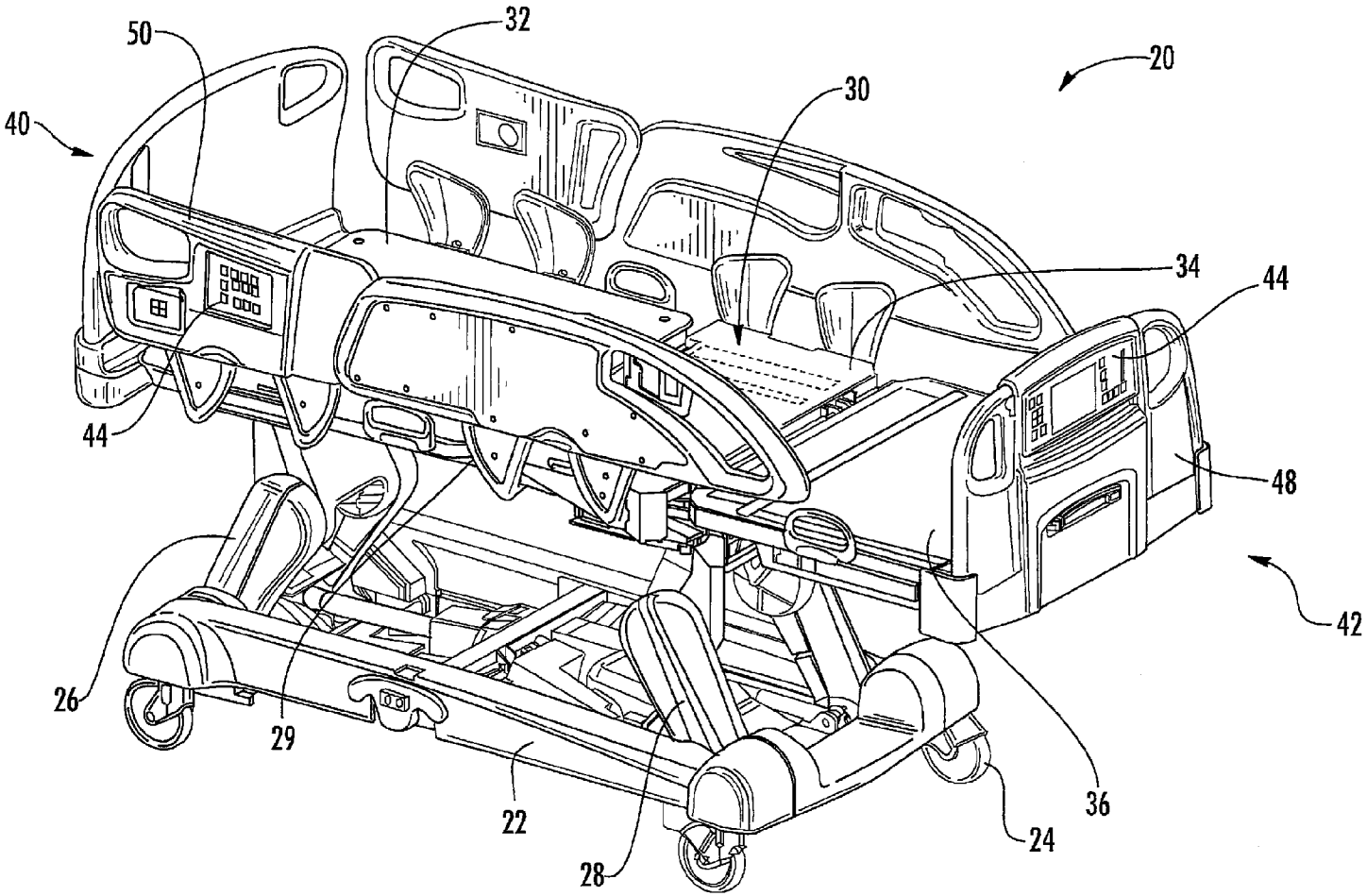
FIG. 1 is a perspective view of one example of a patient support apparatus that may incorporate a CPR drop assembly according to one aspect of the present invention.

The present invention will now be described with reference to the accompanying drawings wherein the reference numerals appearing in the following written description correspond to like-numbered elements in the accompanying drawings. A patient support apparatus 20 which may be modified to incorporate a CPR drop assembly according to one aspect of the invention is depicted in FIG. 1. Patient support apparatus 20 includes a base 22 having a plurality of wheels 24, a head elevator 26, a foot elevator 28, a frame 29 supported by head and foot elevators 26 and 28, and a patient support deck 30 that includes a head section 32, a seat section 34, and a foot section 36. Wheels 24 allow patient support apparatus 20 to be rollingly transported to different locations. Head and foot elevators 26 and 28 enable the patient support deck 30 to be raised and lowered in a manner that is described in more detail in commonly-assigned, co-pending U.S. patent application Ser. No. 11/612,361, filed Dec. 18, 2006 by inventors LeMire et al. and entitled Hospital Bed, the complete disclosure of which is hereby incorporated herein by reference.

Figure 2:
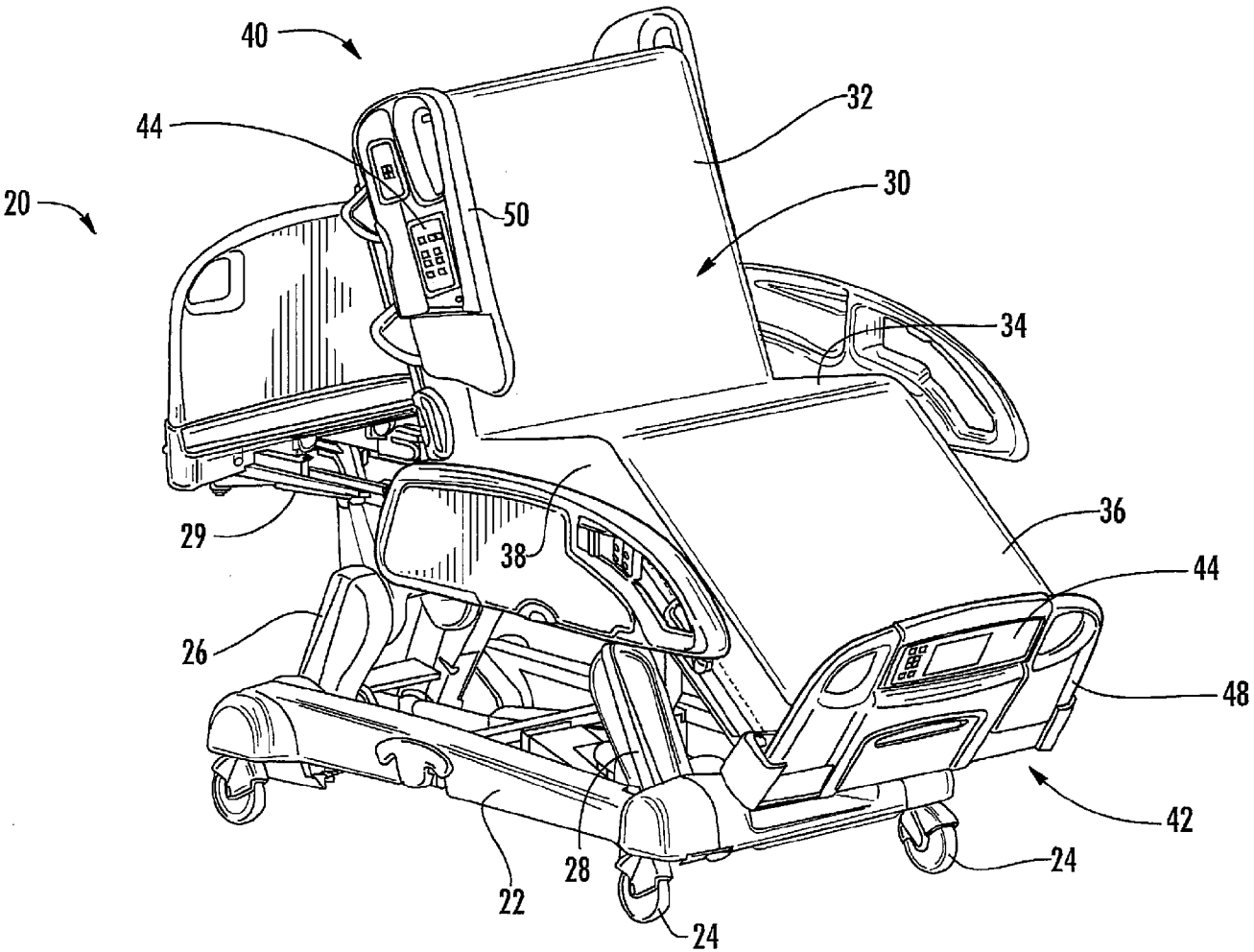
FIG. 2 is a perspective view of the patient support apparatus of FIG. 1 illustrated with an upwardly pivoted patient head section, a generally flat patient seat section, and a downwardly pivoted foot section.

As is illustrated more clearly in FIG. 2, patient support deck 30 can be pivoted to a variety of different orientations. In FIG. 2, head section 32 of support deck 30 has been pivoted upwardly. More specifically, the end of head section 32 nearest a head end 40 of patient support apparatus 20 has been pivoted to a raised orientation, while the end of head section 32 oriented toward a foot end 42 of patient support apparatus 20 has generally remained in its same position. Foot section 36 has been pivoted such that its foot end has been lowered from the horizontal orientation of FIG. 1. Seat section 34 has been pivoted slightly such that the foot end of seat section 34 is slightly higher than the head end of seat section 34.

Figure 3:
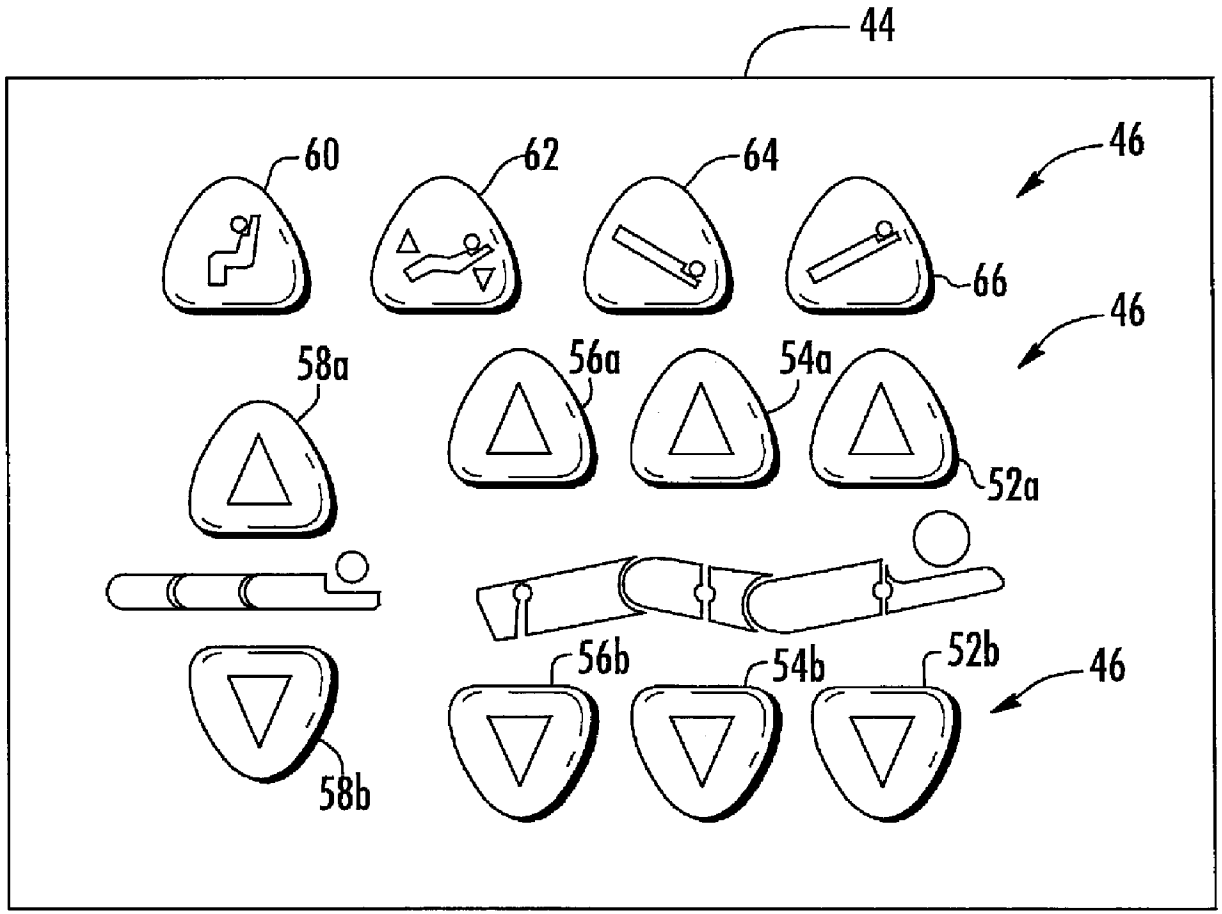
FIG. 3 is an illustrative example of a control panel that may be used on the patient support apparatus of FIG. 1.

The pivoting of the various sections of support deck 30 can be controlled via a control panel 44, such as the control panel 44 depicted in FIG. 3. Control panel 44 may be mounted at any suitable location on patient support apparatus 20. Multiple control panels 44 may also be included on patient support apparatus 20. In the embodiment illustrated in FIGS. 1 and 2, a control panel 44 is mounted to a footboard 48 as well as to a siderail 50. Another control panel 44 could also be mounted to another siderail 50, such as one located on the opposite side of that depicted in FIG. 1.

Control panel 44 includes a plurality of user activated controls 46 which may take on a variety of different forms, such as, but not limited to, buttons, switches, knobs, touch screens, or any other type of device which a user can activate to control one or more selected features of patient support apparatus 20. In the embodiment illustrated in FIG. 3, user activated controls 46 are buttons. The adjustment functions of support deck 30 that may be included on control panel 44 can be varied from that illustrated in FIG. 3. Indeed, in one aspect of the present invention, control panel 44 can be entirely eliminated. In other aspects of the present invention, fewer user activated controls 46 than those depicted in FIG. 3 may be used. Still further, it is possible to include additional controls beyond those illustrated in the control panel 44 depicted in FIG. 3.

The control panel 44 of FIG. 3 includes user activated controls 52*a* and *b* for independently adjusting the orientation of head section 32 of support deck 30. User activated control 52*a* pivots head section 32 upwardly while user activated control 52*b* pivots head section 32 downwardly. User activated controls 54*a* and *b* independently control the pivoting of seat section 34 upwardly and downwardly, respectively. User activated controls 56*a* and *b* independently control the pivoting of foot section 36 upwardly and downwardly, respectively. User activated controls 58*a* and *b* control the upward and downward movement, respectively, of the entire support deck 30. Stated alternatively, user activated control 58*a* and *b* will simultaneously move head section 32, seat section 34, and foot section 36 upwardly or downwardly, respectively. User activated control 60 will automatically pivot head section 32, seat section 34, and foot section 36 such that the patient will move to a sitting up orientation, such as illustrated by the diagram on seat control 60. User activated control 62 will rotate head section 32, seat section 34, and foot section 36 upwardly or downwardly together as one unit. User activated control 64 will automatically orient head section 32, seat section 34, and foot section 36 such that they are generally coplanar and angled so that the patient's head is oriented at a lower elevation than the patient's feet. User activated control 66 will also automatically move head section 32, seat section 34, and foot section 36 such that they will become generally coplanar and angled with the head of the patient oriented at a higher elevation than the patient's feet.

Figure 4:
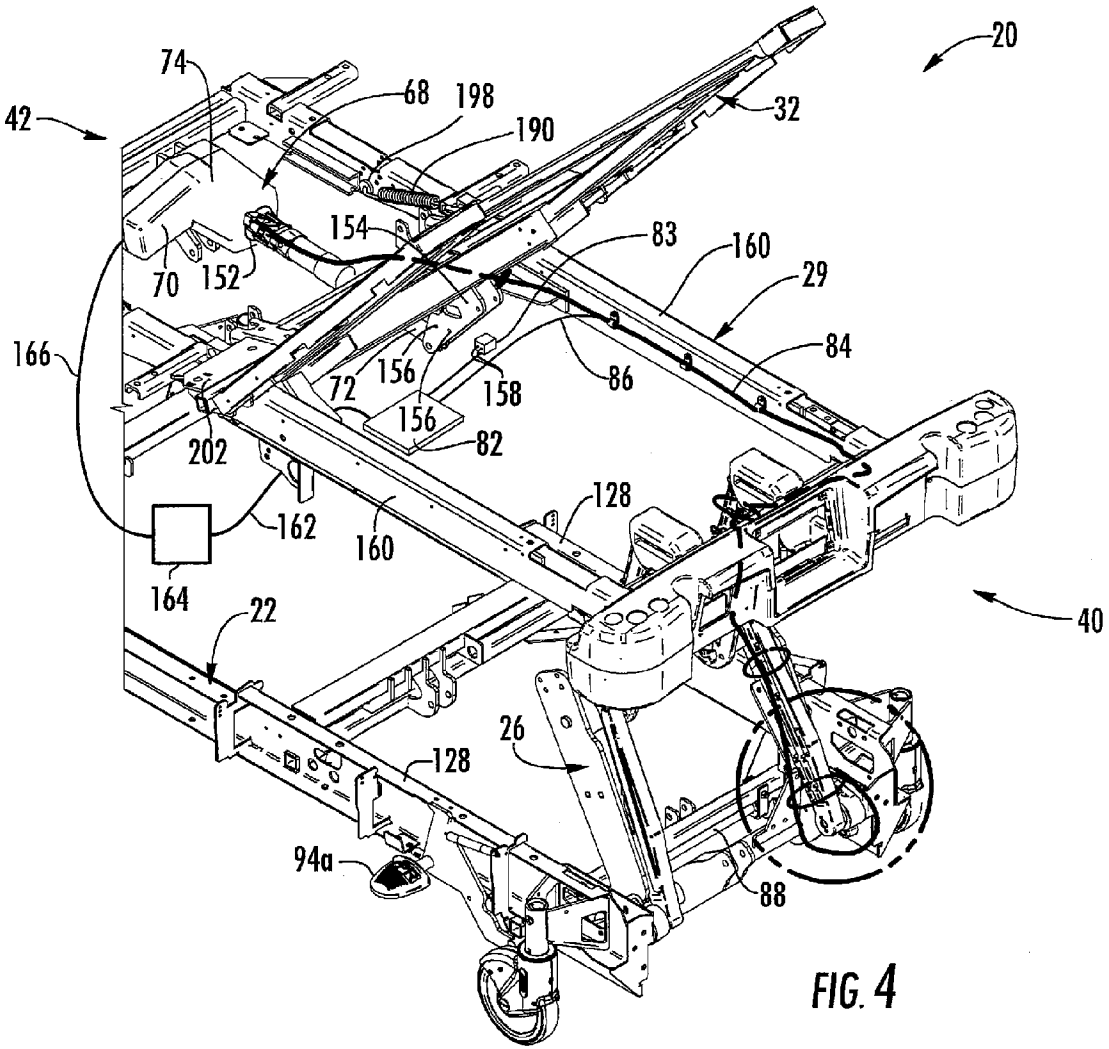
FIG. 4 is a partial, perspective view of various components of a patient support apparatus incorporating an emergency CPR drop mechanism according to one aspect of the present invention.

The manner in which controls 54, 56, 58, 60, 62, and 64 operate will not be described herein in more detail other than to say that the operation of these controls is described in the above-referenced application Ser. No. 11/612,361 which was incorporated herein by reference. The manner in which user activated controls 52*a* and *b* raise and lower head section 32 of deck 30, however, will now be described in more detail. When either of user activated controls 52*a* or *b* are pushed, an electrical signal is sent from control panel 44 to an actuator 68 (FIG. 4). This electrical signal may pass through a controller, such as will be described below, before being transmitted to actuator 68, or it may be transmitted directly to actuator 68. In either situation, activation of either control 52*a* or b causes electrical power to be supplied to actuator 68. Actuator 68 includes an electrical motor (not shown) that is positioned inside of an actuator housing 70. Actuator 68 includes a telescoping member 72 that, upon activation of the actuator motor, either expands out of or contracts into a base portion 74 of actuator 68. More specifically, in the example illustrated in FIG. 4, activation of control 52*a* will cause the motor of actuator 68 to run in such a direction that telescoping member 72 (FIG. 14) extends out of base portion 74 toward head end 40 of patient support apparatus 20. In contrast, activating control 52*b* will cause the motor in actuator 68 to retract into telescoping member 72 toward foot end 42, thereby causing head section 32 to pivot downwardly toward the horizontal orientation. It should be noted that activation of control 52*b* to lower head section 32 will cause head section 32 to be lowered at a rate dictated by the speed of the motor in actuator 68. That is, head section 32 cannot be lowered faster than the speed dictated by the motor in actuator 68 when control 52*b* is actuated. In emergency situations, it is therefore desirable to include a CPR drop assembly that allows head section 32 to be lowered more quickly than can be accommodated by driving the motor in actuator 68.

Figure 5:
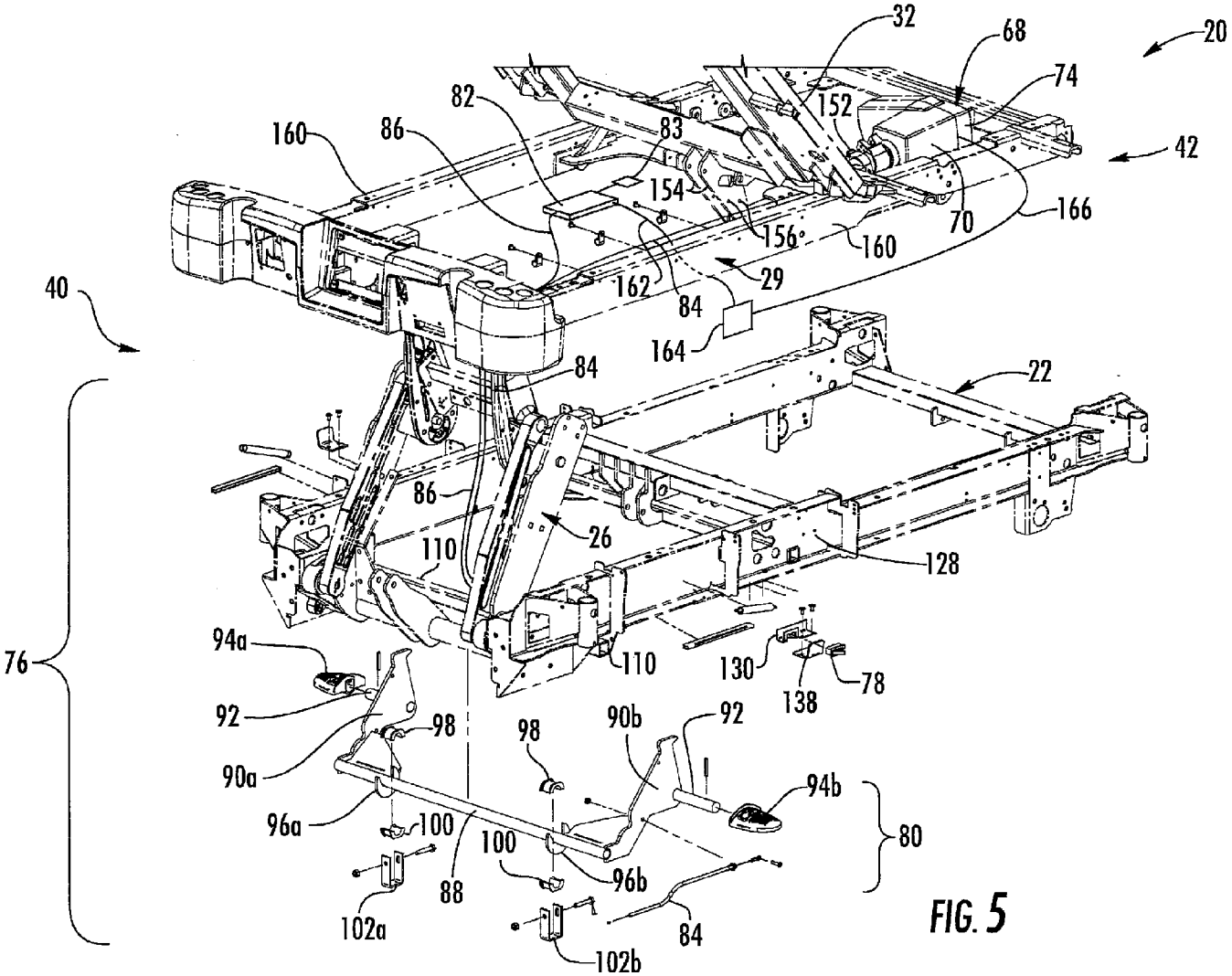
FIG. 5 is a perspective view of the patient support apparatus of FIG. 4 illustrating a foot pedal assembly in an exploded format.
Figure 13:
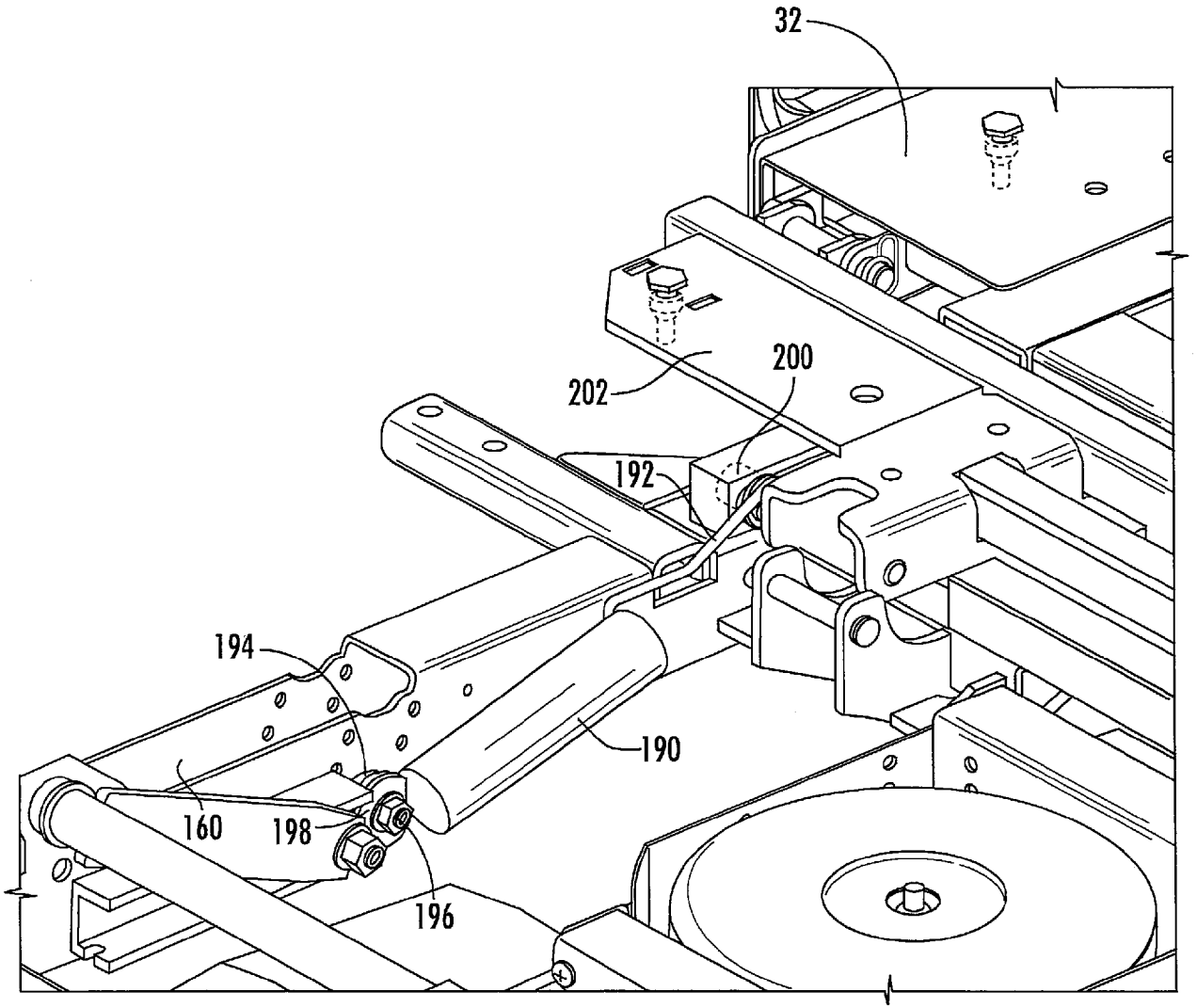
FIG. 13 is a perspective view of a spring coupled between a frame of the patient support apparatus of FIG. 4 and a head section of a patient support deck.
Figure 14:
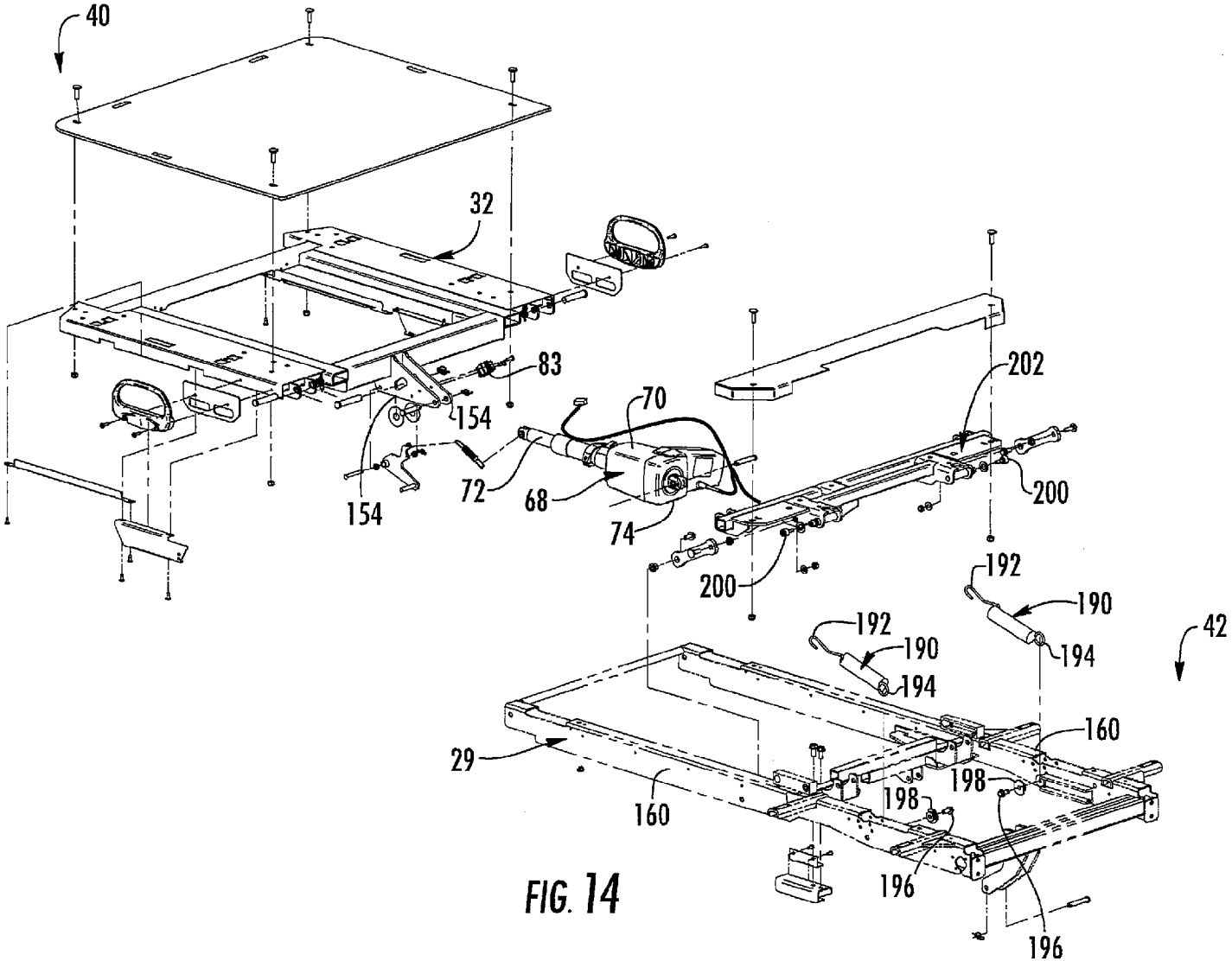
FIG. 14 is an exploded, perspective view of the support deck of the patient support apparatus of FIG. 4, including the frame, the head section, and an intermediate section.

FIG. 5 illustrates a CPR drop assembly 76 according to one aspect of the present invention. In general, CPR drop assembly 76 includes an electrical sensor 78, a mechanical crank assembly 80, a controller 82, an angle sensor 83, actuator 68, a mechanical link 84, and an electrical link 86. CPR drop assembly 76 may also include a pair of springs 190 (FIGS. 13 and 14). All of the components of CPR drop assembly 76 operate in a manner that enables head section 32 to be quickly lowered to a horizontal orientation at a speed greater than that dictated by the motor of actuator 68. Each of these components, as well as the manner in which they operate, will now be described in more detail.

Figure 6:
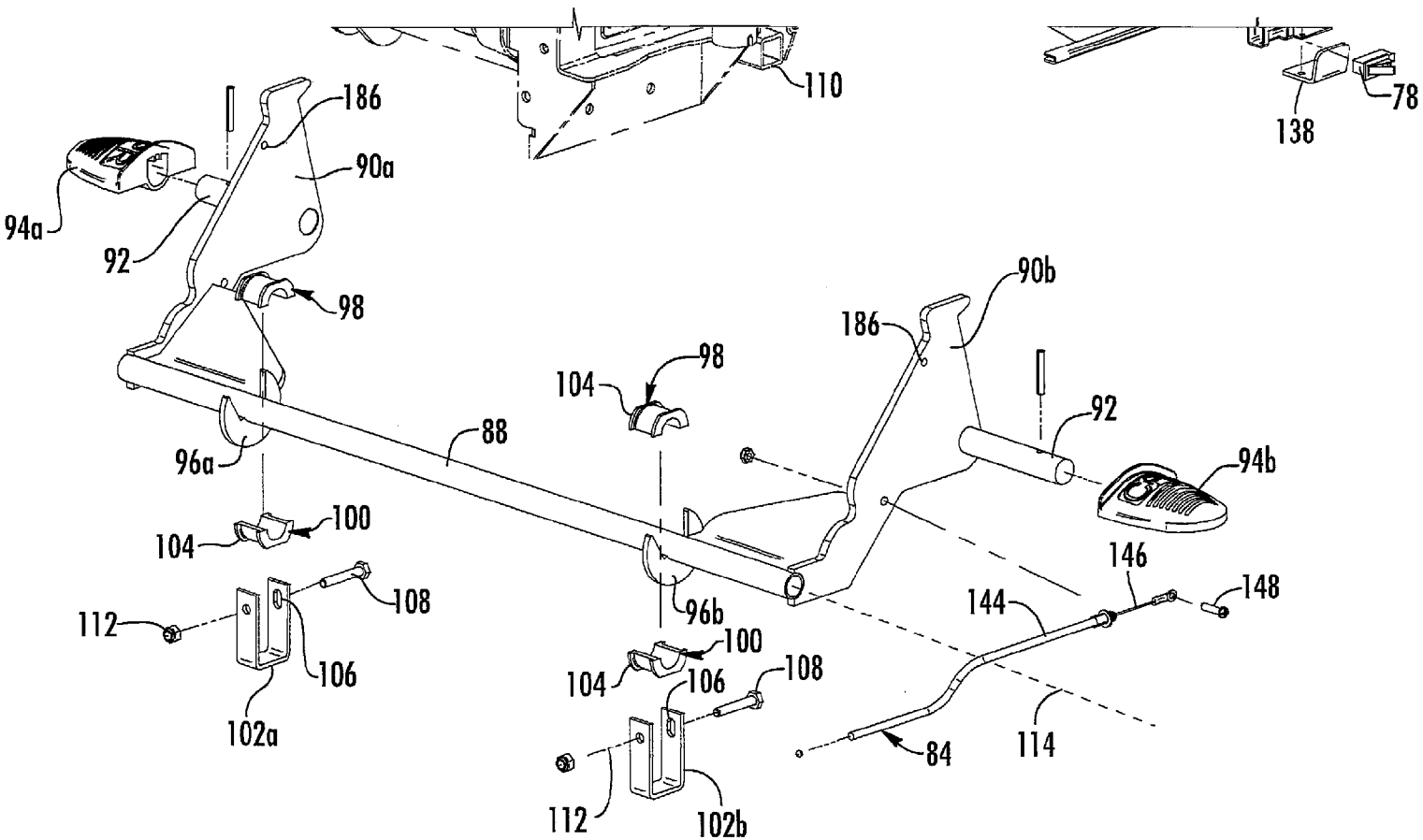
FIG. 6 is an enlarged, exploded, perspective view of the foot pedal assembly of FIG. 5.

FIG. 6 illustrates the crank assembly 80 of FIG. 5 in an enlarged view. As can be seen more clearly in FIG. 6, crank assembly 80 includes a rotatable shaft 88 that extends from one side of the patient support apparatus 20 to an opposite side. A pair of crank arms 90*a* and 90*b* are attached to the ends of rotatable shaft 88. Each crank arm 90 includes a cylindrical extension 92 to which a foot pedal 94 is secured. A pair of partial discs 96*a* and *b* are secured to rotatable shaft 88 generally near each end of rotatable shaft 88. Crank assembly 80 further includes a pair of upper bearings 98 and lower bearings 100, as well as a pair of bearing brackets 102*a* and *b*. Each upper bearing 98 and lower bearing 100 includes an interior, semi-circular surface which envelopes rotatable shaft 88. Upper bearings 98 and lower bearings 100 further include an outer flange 104 on each of their sides. The distance between outer flanges 104 on any one of upper or lower bearings 98 and 100 is slightly larger than the width of bearing bracket 102. This enables upper and lower bearings 98 and 100 to seat themselves around bearing brackets 102 in a manner that is illustrated more clearly in FIG. 7.

Figure 7:
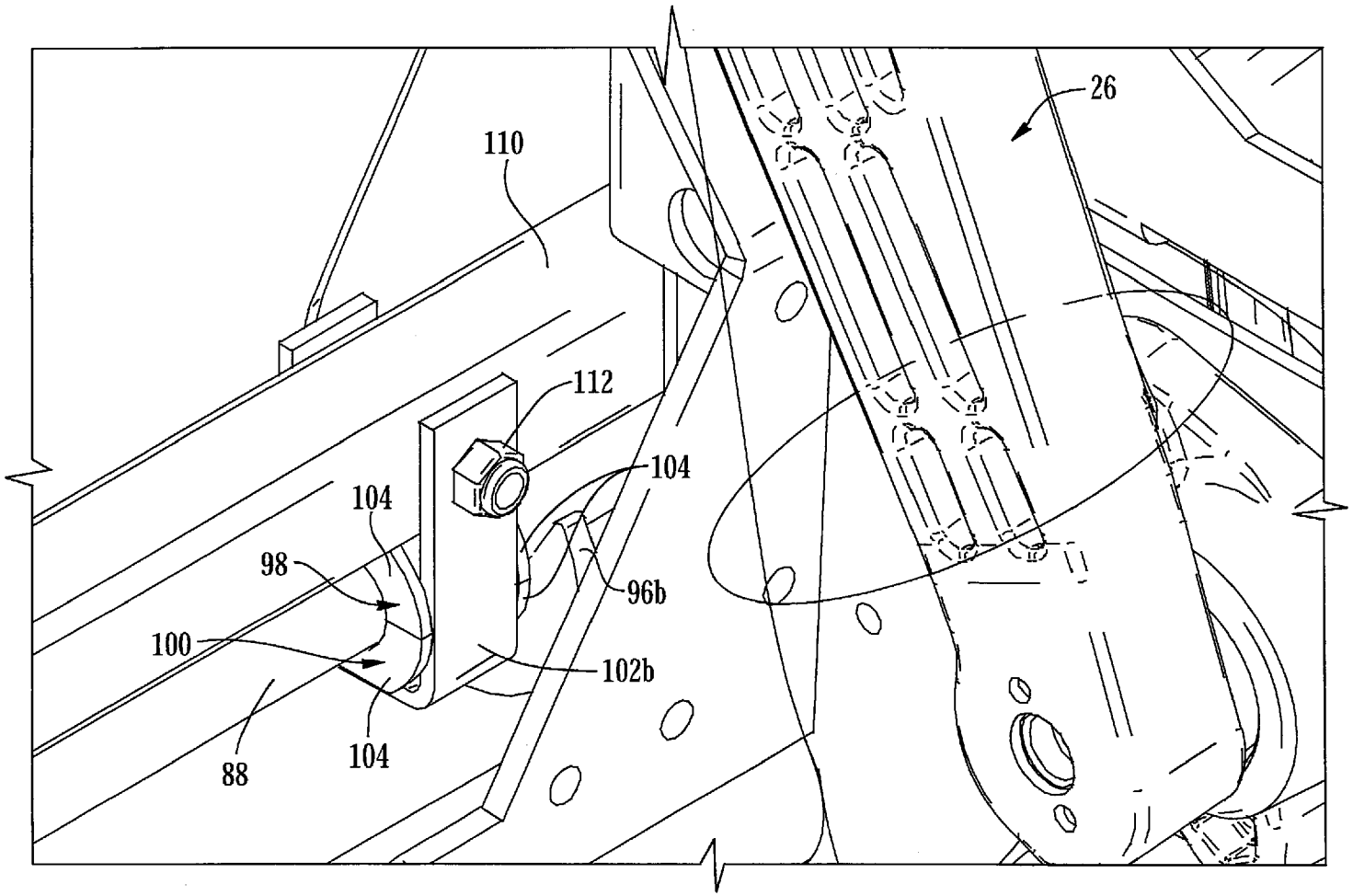
FIG. 7 is an enlarged, perspective view of a bearing bracket that attaches a rotatable shaft to a cross member of the patient support apparatus.

Each bearing bracket 102 includes a pair of apertures 106 which receive a bolt 108 (FIG. 6). Bolt 108 also pass through an aperture defined in a cross member 110 of the base 22 of patient support apparatus 20 (FIGS. 5 and 7). A nut 112 is secured to bolt 108 after it has passed through aperture 106 and cross member 110 (FIGS. 5 and 6). Upper and lower bearings 98 and 100 are made from any suitable non-metallic material that allows easy rotation of shaft 88 and that eliminates squeaking that otherwise might be generated by the rotation of rotatable shaft 88. As can be seen more clearly in FIG. 7, bearing bracket 102 fixedly secures upper and lower bearings 98 and 100 to cross member 110. Outer flanges 104 prevent upper and lower bearings 98 and 100 from moving laterally with respect to bearing bracket 102. Further, bearing bracket 102 secures upper and lower bearings 98 and 100 sufficiently close to the underside of cross member 110 such that the flat surfaces on the top and bottom of upper and lower bearings 98 and 100, respectively, (FIG. 6) are pressed against the underside of cross member 110 and the bottom of bracket 102, respectively. This fit prevents upper and lower bearings 98 and 100 from moving vertically and from rotating.

Each bearing bracket 102 is attached to cross member 110 adjacent one of partial discs 96*a* and *b*. More specifically, bearing brackets 102*a* and *b* are attached to cross member 110 at locations immediately to the interior of partial discs 96*a* and *b*. This prevents rotatable shaft 88 from sliding laterally from one side of the patient support apparatus 20 to another. Stated alternatively, rotatable shaft 88 cannot move leftward in FIG. 6 because partial disc 96*b* is prevented from leftward movement by bearing bracket 102*b*. Similarly, rotatable shaft 88 in FIG. 6 cannot move rightward because partial disc 96*a* is preventing from rightward movement by bearing bracket 102*a*. Bearing brackets 102*a* and *b*, along with upper and lower bearings 98 and 100, both secure rotatable shaft 88 to cross member 110 in a manner that prevents lateral movement, but allows rotatable shaft 88 to rotate about its longitudinal axis. Stepping on either one of foot pedals 94 will therefore cause crank arms 90 and rotatable shaft 88 to rotate about a pivot axis 114 (FIG. 6).

Figure 8:
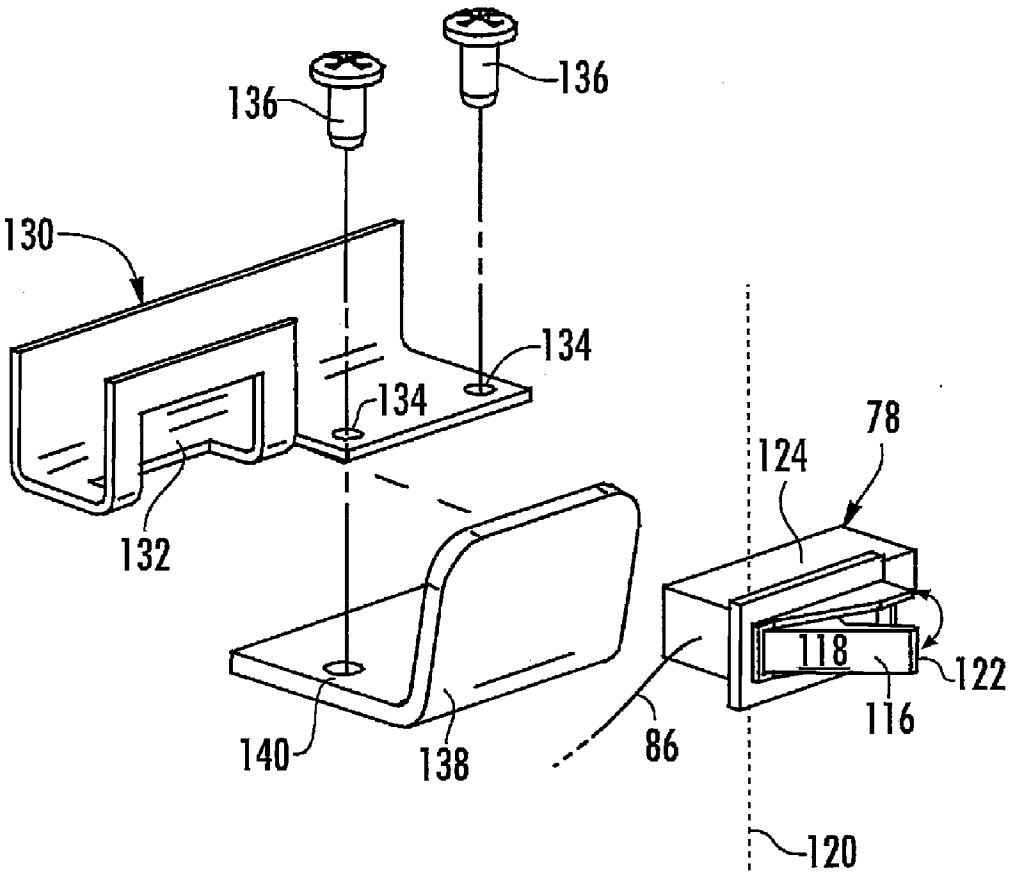
FIG. 8 is a perspective view of an electrical foot pedal sensor.

The electrical sensor 78 of CPR drop assembly 76 is illustrated in more detail in FIG. 8. Electrical sensor 78 includes an angled switch 116 having an outer surface 118. Angled switch 116 is generally pivotable about a vertical axis 120 such that an outer end 122 of angled switch 116 can be pivoted inwardly toward a body 124 of sensor 78. This inward pivoting of angled switch 116 into body 124 activates sensor 78. Thus, when angled switch 116 is pivoted into body 124, sensor 78 transmits an electrical signal along electrical link 86, which is electrically coupled to controller 82. Electrical link 86 may comprise one or more conventional wires or any other means for transmitting an electronic signal from sensor 78 to controller 82, such as, but not limited to, a wireless transmitter and receiver. When electrical link 86 is a wire, the precise manner in which it is threaded through the body of apparatus 20 from sensor 78 to controller 82 can assume any suitable configuration, and it will be understood that the illustrated threading is only one of many possible routes. The manner in which controller 82 responds to the electrical signal from sensor 78 will be described in more detail below.

Figure 9:
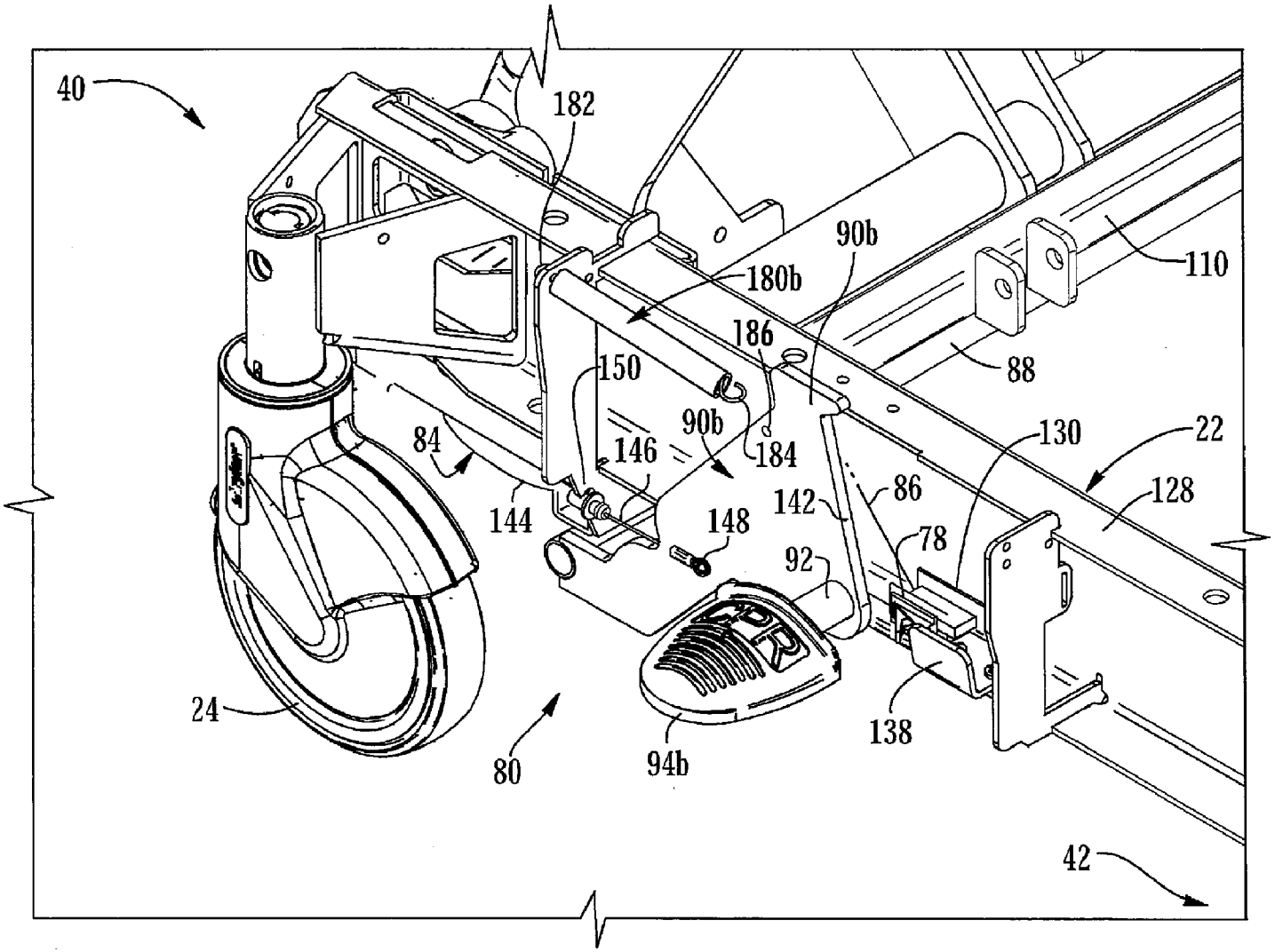
FIG. 9 is a perspective view of a portion of the foot pedal assembly of FIG. 5 shown in an unexploded format and along a first side of the patient support apparatus.
Figure 10:
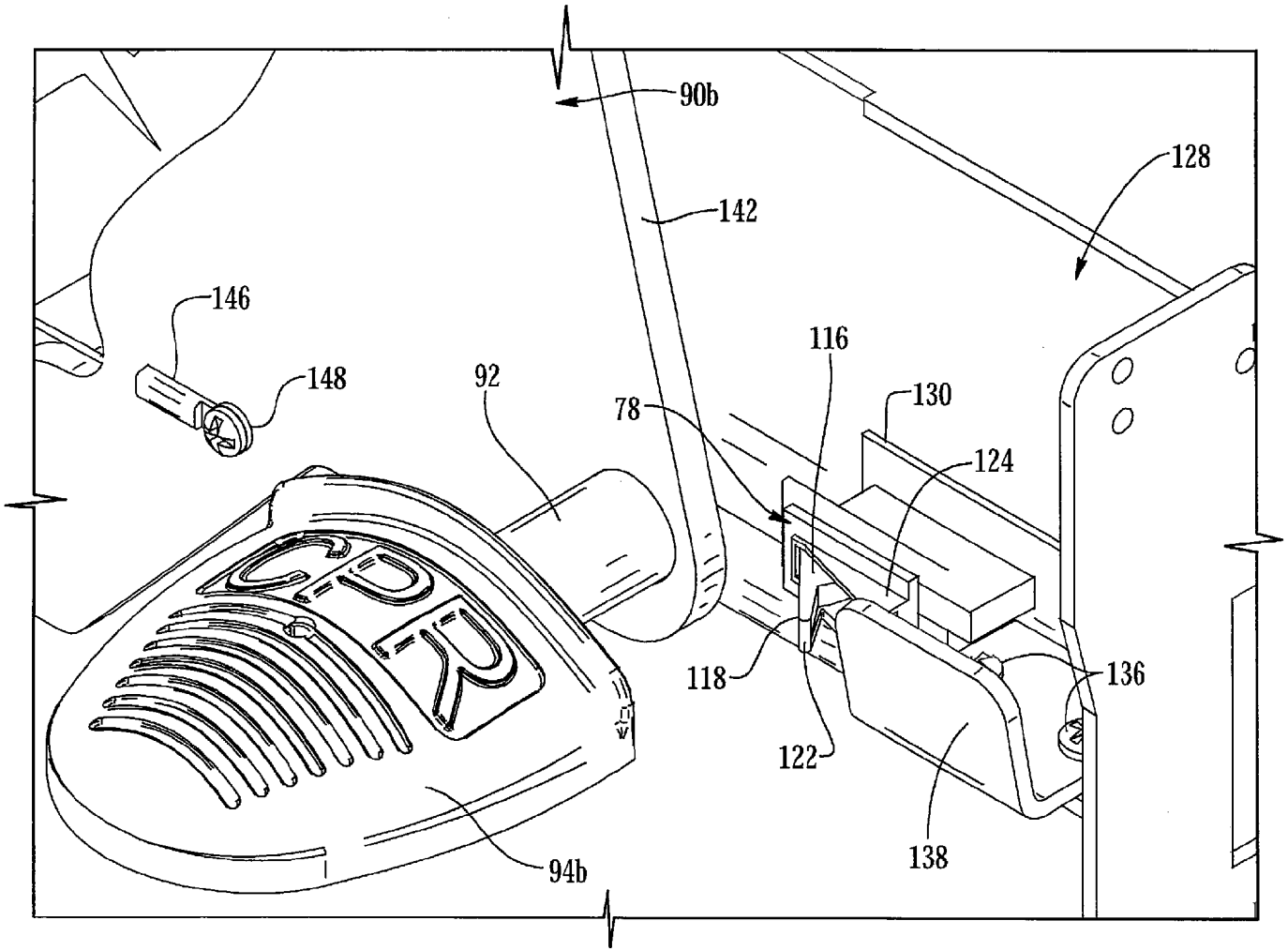
FIG. 10 is an enlarged, perspective view of the foot pedal assembly of FIG. 9.

Sensor 78 is mounted to a side rail 128 of base 22 by way of a sensor bracket 130 (FIG. 8). Sensor bracket 130 includes a generally rectangular aperture 132 that is dimensioned to receive the body 124 of sensor 78. Sensor bracket 130 includes a pair of apertures 134 dimensioned to receive a pair of screws 136 that are also inserted into corresponding apertures defined in side rail 128 (not shown). A shield 138 also includes a pair of apertures 140 which receive screws 136 and thereby secure shield 138 to side rail 128, as well as bracket 130. Shield 138 may be positioned on top of sensor bracket 130 such that screws 136, when inserted from above sensor bracket 130, first pass through the apertures 140 of shield 138 before passing through apertures 134 of bracket 130. FIGS. 9 and 10 illustrate in greater detail the manner in which sensor 78, sensor bracket 130, and shield 138 are configured when attached to siderail 128.

As can be seen more clearly in FIGS. 9 and 10, sensor 78 is attached to siderail 128 at a location in which crank arm 90*b* will impinge angle switch 116 when a user steps on either of foot pedals 94*a* and *b*. More specifically, when a user steps on one of foot pedals 94*a* and *b*, rotatable shaft 88 will rotate about pivot axis 114, thereby allowing crank arms 90*a* and *b* to likewise pivot about pivot axis 114. This pivoting will cause a rear edge 142 of crank arm 90*b* to come into contact with angled switch 116. As crank arm 90*b* is further pivoted about pivot axis 114, rear edge 142 will cause angled switch 116 to pivot inwardly into the body 124 of sensor 78, thereby activating sensor 78. Because both crank arms 90*a* and *b* are fixedly attached to rotatable shaft 88, sensor 78 will be activated regardless of which foot pedal 94*a* and *b* the user presses. In other words, with reference to FIG. 5, if a user presses foot pedal 94*a*, this will cause a rotation of rotatable shaft 98. Rotation of rotatable shaft 88 will likewise cause a rotation of the crank arm 90*b* to which foot pedal 94*b* is attached. Thus, pressing foot pedal 94*a* will likewise cause foot pedal 94*b* to pivot downwardly and vice versa. Therefore, regardless of which foot pedal 94*a* or 94*b* is pressed, the crank arm 90 to which foot pedal 94*b* is attached will pivot downwardly and activate sensor 78.

Figure 11:
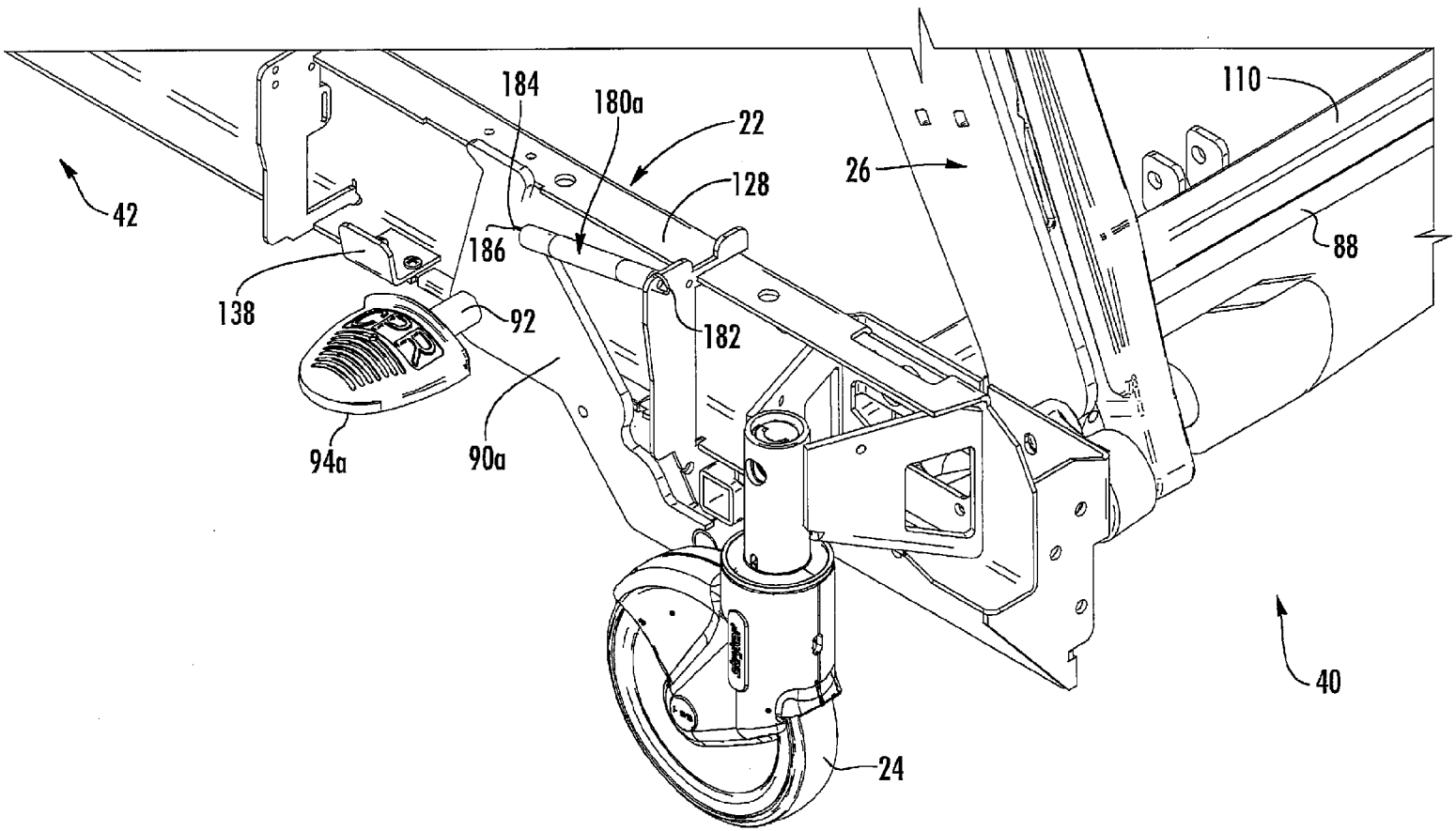
FIG. 11 is a perspective view of a portion of the foot pedal assembly of FIG. 5 shown in an unexploded format and along a second side of the patient support apparatus, the second side being opposite to the first side shown in FIG. 9.

A spring 180*b* having a head end 182 and a foot end 184 may be coupled between a fixed portion of base 22 and crank arm 90*b* (FIG. 9). Crank arm 90*b* includes a spring aperture 186 that receives foot end 184 of spring 180*b*. Spring 180*b* is pulled into a state of tension by the pivoting of crank arm 90*b* when either of pedals 94*a* or *b* are pressed. This tension exerts a force that urges foot pedals 94*a* and *b* upward so that the pedals will return to the non-activated positions illustrated in FIGS. 9-11 after a user has stopped pressing his or her foot downward on pedal 94*a* or *b*. A spring 180*a* (FIG. 11) operates on crank arm 90*a* in the same manner as has been described with respect to spring 180*b* and crank arm 90*b*.

In addition to activating sensor 78, the downward pivoting of crank arm 90*b* also activates mechanical link 84 (FIG. 9). Mechanical link 84 may take on any configuration that is capable of transferring the mechanical motion of crank arm 90*b* to a mechanical motion that acts upon actuator 68. In the embodiment illustrated in FIG. 9, mechanical link 84 is a conventional Bowden cable having an outer sleeve 144 and an inner cable 146. Inner cable 146 is attached at one end to crank arm 90*b* by way of a screw 148. Outer sleeve 144 is attached to a stationary bracket 150 mounted on siderail 128 of base 22. Thus, when crank arm 90*b* is pivoted downwardly by way of a user stepping on either one of pedals 94*a* or *b*, inner cable 146 will be pulled while sleeve 144 will remain stationary. The movement of inner cable 146 with respect to outer sleeve 144 is transmitted to a release 152 on actuator 68 (FIG. 4). The route through the interior of patient support apparatus 20 which mechanical link 84 may take is generally illustrated in FIGS. 4 and 5, though this can be varied.

The activation of release 152 initiates a freewheeling capability of actuator 68. This freewheeling capability allows the telescoping member 72 of actuator 68 to retract into base portion 74 at a speed greater than that dictated by the operating speed of the motor of actuator 68. When release 152 is not activated by way of mechanical link 84, the movement of telescoping member 72 into or out of base portion 74 occurs at a speed dictated by the speed of the motor within actuator 68. Because this speed is typically not as fast as is desired in emergency situations, release 152 is activated in emergency situations, thereby allowing head section 32 to pivot downwardly to a horizontal orientation more quickly than that which would otherwise occur if the motor or actuator 68 were dictating the pivoting speed of head section 32. The activation of release 152 allows head section 32 to pivot downwardly to a horizontal orientation more quickly because the weight of both head section 32 and the patient's torso will assist in pivoting head section 32 downwardly. The natural tendency of the patient to lie flat will also urge head section 32 downward when release 152 is activated. A person standing next to patient support apparatus 20 can also push down on head section 32 after release 152 has been activated to speed up the downward pivoting of head section 32, if desired. Still further, the downward movement of head section 32 may be assisted by the force of a pair of springs 190 (FIGS. 13 and 14), as will be discussed in greater detail below.

While a variety of different actuators 68 can be used within the scope of the present invention, one suitable actuator is a model LA34 linear actuator manufactured by Linak of Gudrup, Denmark. This actuator includes a free-wheeling feature that allows head section 32 to be pivoted to the horizontal orientation at a rate faster than the electrical motor could otherwise drive it. Other models of linear actuators, as well as other types of actuators, can also be used within the scope of the present invention.

In summary, the downward pivoting of head section 32 when release 152 has not been activated will occur at a speed dictated by the motor within actuator 68. Thus, if release 152 has not been activated, actuator 68 will resist the various forces urging head section 32 downward, including the gravitational forces of the patient's weight and head section 32's weight, the force of one or more springs 190, any external forces applied by one or more people standing next to patient support apparatus 20, and any forces exerted by the patient himself. In such a situation, only the force of the motor will move head section 32 downwardly. However, when release 152 is activated, the freewheeling feature of actuator 68 is activated and any or all of the forces just mentioned will urge head section 32 downward (i.e. the gravitational force and the force of spring(s) 190 and any forces applied by the patient or people standing next to patient support apparatus 20 will help speed the downward pivoting of head section 32). The activation of release 152 thus frees telescoping member 72 from the restraints of the actuator motor. This freedom assures that CPR drop assembly 76 will cause head section 32 to pivot to the horizontal orientation even in the absence of electrical power, such as during a power outage or battery failure.

Angle sensor 83 (FIGS. 4 and 14) may be attached to a pair of extensions 154 fixedly mounted to the underside of head section 32. As can be seen in FIG. 4, extensions 154 include a pair of apertures 156 which are dimensioned to receive corresponding fasteners (not shown), such as screws, bolts, or the like. The fasteners inserted through apertures 156 likewise fit into a corresponding pair of apertures 158 defined in angle sensor 83. The fasteners thereby mount angle sensor 83 to extensions 154. Further, because extensions 154 are fixedly mounted to head section 32, the rotation of head section 32 will cause a corresponding rotation of extension 154 and angle sensor 83. Angle sensor 83 detects this pivoting.

More specifically, angle sensor 83 detects it angular orientation with respect to horizontal. Angle sensor 83 may be any conventional sensor capable of detecting an angle with respect to horizontal. Such sensors include accelerometers, inclinometers, inertial sensors, or any other type of sensor capable of detecting an angular deviation from a horizontal orientation. Angle sensor 83 may alternatively be a sensor that detects an angular orientation of head section 32 relative to another component of patient support apparatus 20, such as any non-pivoting component of patient support apparatus 20. One such component might be either of the pair of sidebeams 160 illustrated in FIG. 4. Other stationary components could also be used as a reference for angle sensor 83. If angle sensor 83 detects a relative orientation, the actual angle of head section 82 with respect to horizontal may be slightly different than the relative angular reading output by sensor 83 because patient support apparatus 20 may be positioned on a floor that is not truly horizontal. However, such a relative orientation of head section 32 may still be used within the scope of the invention, as well as an absolute angular measurement with respect to true horizontal.

The angle sensed by sensor 82, whether an absolute or relative angular measure, is fed to controller 82. Controller 82 is in electrical communication with sensor 78 by way of electrical link 86, which may include a conventional wire or other means of communicating electrical signals between sensor 78 and controller 82. Controller 82 is also in electrical communication with an electrical power supply 164 by way of a wire 162 (FIGS. 4 and 5). It will be understood that the physical location of electrical power supply 164 and controller 82, as shown in FIGS. 4 and 5, does not necessarily reflect the actual physical location of either electrical power supply 164 or controller 82 on patient support apparatus 20, and that the routing of the wires to and from controller 82 and power supply 164 will vary in accordance with the actual location of these structures. The actual physical locations of controller 82 and electrical power supply 164 can be anywhere on patient support apparatus 20 so long as they are coupled together in the manner described herein.

Electrical power supply 164 is capable of providing sufficient electrical power to actuator 68 to drive the motor within actuator 68. Electrical power supply 164 supplies electrical power to actuator 68 by way of a wire 166. Controller 82 issues a control signal along wire 162 to electrical power supply 164 that selectively causes electrical power supply 164 to supply electrical power to actuator 68. Power supply 164 may be a battery or an electrical connection to an electrical outlet positioned in a nearby room wall, or it may include a combination of a battery and a connection to an electrical outlet.

Figure 12:
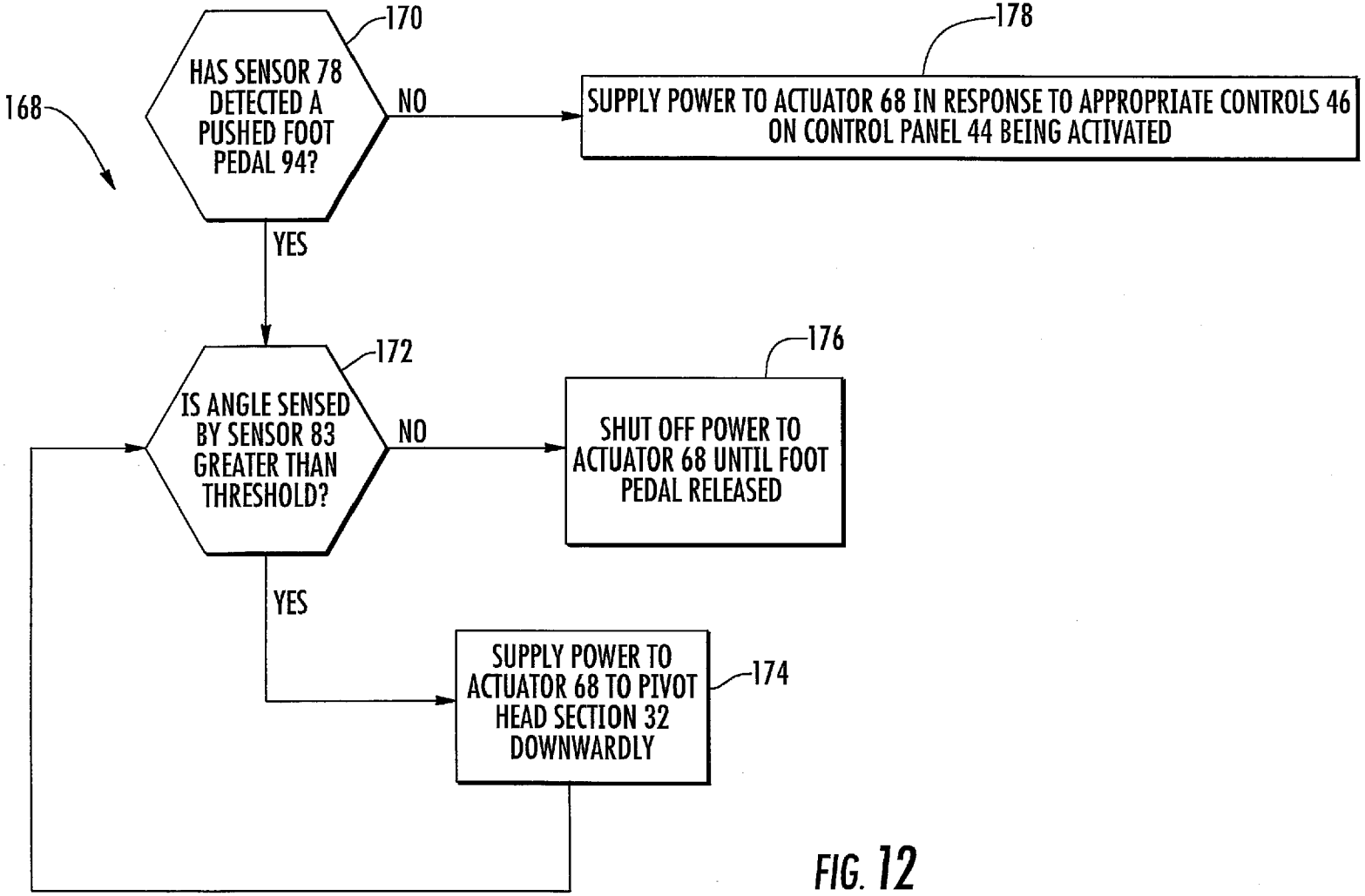
FIG. 12 is a flowchart illustrating the steps followed by a controller during operation of the CPR drop assembly.

Controller 82 determines whether or not to provide electrical power to actuator 68 based upon the outputs from angle sensor 83 and electrical sensor 78. Specifically, controller 82 follows the control steps 168 illustrated in FIG. 12. At a step 170, controller 82 determines whether sensor 78 has detected that the foot pedals 194 have been pushed. If sensor 78 detects that a pedal has been pushed, controller 82 moves to step 172 where it determines whether angle sensor 83 has detected an angle that is greater than a threshold angle. The threshold angle can be set to a variety of different values in accordance with the present invention, such as any angle from five degrees up to ninety degrees. In one embodiment, the threshold angle is set to a value of twenty degrees. If controller 82 determines at step 172 that the angle sensed by sensor 83 is greater than the threshold, then controller 82 proceeds to step 174.

At step 174, controller 82 outputs a signal on wire 162 to electrical power supply 164 directing the power supply 164 to provide electrical current to actuator 68. The current that is supplied operates the motor of actuator 68 so as to drive head section 32 downwardly toward the horizontal orientation. After step 174, controller 82 returns to step 172 and determines whether or not the current angle of head section 32 is greater than the threshold angle. If it is, controller 82 returns to step 174 and continues to supply power to actuator 68. If it is not, controller 82 proceeds to step 175 where it shuts off power to actuator 68. The frequency at which controller 82 continues to re-check the angle of head section 32 with respect to the threshold angle (step 172) can vary greatly within the scope of the present invention. However, one suitable frequency is multiple times per second.

In overview, controller 82 will continue to direct power to actuator 68 after a foot pedal 94 has been pressed for so long as head section 32 is oriented at an angle greater than the threshold angle. This electrical power will cause the motor of actuator 68 to drive head section 32 toward the horizontal orientation. This downward driving of head section 32 will occur simultaneously with the activation of release 52 via mechanical link 84. Thus, head section 32 will pivot downwardly at least as fast as the motor in actuator 68 can drive it. However, as noted above, the activation of release 152 will allow head section 32 to pivot downwardly even faster than that dictated by the motor of actuator 68. In practical situations, the weight of the patient's torso and head section 32, along with springs 190 (discussed below) will urge head section 32 downwardly at a rate greater than the rate dictated by the motor of actuator 68. When angle sensor 83 detects that head section 32 has reached the threshold angle, such as 20 degrees or another value, controller 82 will shut off electrical power to the motor of actuator 68. This termination of electrical power to actuator 68 will not, however, prevent head section 32 from pivoting completely downward to the horizontal orientation. Rather, because release 152 has been activated, head section 32 will remain free to rotate downwardly without assistance from the motor of actuator 68. Thus, the downward momentum of head section 32 and the forces from gravity, the patient, springs 190, and attending personnel will all urge head section 32 downward such that it is not necessary for the motor of actuator 68 to continue to run. Consequently, the motor of actuator 68 can be shut off prior to head section 32 reaching the horizontal orientation. The shutting off of the motor of actuator 68 prior to reaching the horizontal orientation may help to ensure that head section 32 does not slam into side beams 160 with undue force.

If controller 82 determines at step 170 that no foot pedal 94 has been pressed, it proceeds to step 178. At step 178, controller 82 reacts to the user activated controls 46 of control panel 44 in the appropriate manner. Controller 82 will continue to react to the user activated controls 46 of control panel 44 until it receives a signal from sensor 78, at which point it will proceed to step 172. Controller 82 can take on a variety of different forms, but may include one or more conventional microprocessors or micro controllers capable of being programmed to carry out the control steps 168 illustrated in FIG. 12. Alternatively, controller 82 could be a combination of discrete logical elements configured to carry out the control logic specified in FIG. 12. In general, controller 82 can consist of any electrical components that can be arranged to carry out the control logical illustrated in FIG. 12.

As was noted above, the threshold angle utilized at step 172 can take on a variety of different values. In general, the angular threshold may desirably be set such that actuator 68 will assist in the downward pivoting of head section 32 when the gravitational forces may not be sufficient to quickly force head section 32 downward. Such situations tend to occur the higher head section 32 is pivoted upwardly because the downward torque produced by gravity decreases as the head section is pivoted upwardly (and reaches zero at ninety degrees). At such higher angles, it therefore may be desirable to activate actuator 68 in emergency situations to help assist in initiating the downward movement of head section 32. After the downward movement of head section 32 has been initiated by actuator 68, actuator 68 can be shut off and the momentum of bead section 32 and the patient's torso, along with the weight of gravity (and forces exerted by the patient's body and springs 190), will complete the downward pivoting of head section 32 to the horizontal orientation.

Springs 190 are illustrated in FIGS. 13 and 14. Springs 190 include a head end 192 that faces toward head end 40 of patient support apparatus 20 and a foot end 194 that faces toward foot end 42 of patient support apparatus 20. Foot end 194 is fixedly mounted by way of a screw 196 and washer 198 to side beam 160 of frame 29. Head end 192 is coupled around the rolling axis of a roller 200 that is rollingly coupled to an intermediate section 202 of support deck 30 that lies between seat section 34 and head section 32. The detailed construction of intermediate section 202, as well as its interaction with head section 32, is described in commonly-owned U.S. provisional patent application Ser. No. 60/955,682, entitled Shearless Pivot, filed Aug. 14, 2007, by applicants David Wan Fong, et al, the complete disclosure of which is hereby incorporated herein by reference.

As described more in the above-referenced Shearless Pivot patent application, when head section 32 is pivoted upwardly from the horizontal orientation, intermediate section 202 does not move or pivot until head section 32 reaches a predetermined angle, such as twenty-one degrees, although other values may be used for the predetermined angle. Once head section 32 reaches the predetermined angle, any further upward pivoting of head section 32 will cause intermediate section 202 to move toward head end 40 of patient support apparatus 20, which will, in turn, stretch springs 190. The stretched springs 190 will create a tension force that urges head section 32 back toward the horizontal orientation. This backward urging, however, will be resisted by actuator 68 so long as release 152 has not been activated. Once release 152 has been activated, actuator 68 will no longer resist the forces applied by springs 190 that urge head section 32 toward the horizontal orientation (as well as the other forces that similarly urge head section 32 toward horizontal). Springs 190 will thus urge head section 32 toward the horizontal orientation when release 152 has been activated and head section 32 has been pivoted to an angle greater than the predetermined angle. Once head section 32 has been pivoted back to the predetermined angle, springs 190 will no longer be in tension and will thus cease to urge head section 32 toward the horizontal orientation. However, as noted above, other forces acting against head section 32 will ensure that head section 32 finishes its downward journey to the horizontal orientation.

The predetermined angle discussed above may be the same or different than the threshold angle discussed above and sensed by angle sensor 83. If the predetermined angle and the threshold angle are the same, then the motor of actuator 68 will shut off at the same time as the springs 190 cease to exert a downward force on head section 32 (during an emergency CPR drop). On the other hand, if the predetermined angle and the threshold angle are different, then the motor of actuator 68 will shut off at a different time than the moment when the springs 190 cease to exert a downward force on head section 32. CPR drop assembly 76 can be configured in either manner. Indeed, CPR drop assembly 76 can be configured to omit one or both of springs 190, according to one aspect of the present invention.

The CPR drop assembly 76 can also be modified in accordance with the present invention to include multiple angular threshold values. In one embodiment, a first angular threshold is used to determine whether or not to turn on the motor of actuator 68 and a second, different angular threshold is used to turn off actuator 68. Thus, for example, pressing one of the foot pedals 94 could activate the motor of actuator 68 if head section 32 was initially pivoted higher than, say, fifty degrees (the first threshold), and the activation of the motor could continue until head section 32 reached an angle of, say, twenty degrees (the second threshold). Other values for the first and second thresholds could, of course, be used.

Still further, it would be possible to modify the present invention such that the motor remained activated all the way until head section 32 reached the horizontal orientation. In other variations, the activation of CPR drop assembly 76 could be carried out by way of hand controls, rather than foot pedals.

While the present invention has been described in terms of the embodiments discussed herein, it will be understood by those skilled in the art that the present invention can be modified to include substantial variations from that discussed herein, and encompasses all variations that are within the spirit and scope of the following claims.

What is claimed is:

1. A patient support apparatus having a head end and a foot end comprising:

a base;

a frame;

an elevation mechanism coupled to said base and said frame, said elevation mechanism adapted to raise and lower said frame with respect to said base;

a patient support deck adapted to support a patient, said patient support deck including a pivotable head section adapted to pivot about a horizontal pivot axis oriented generally perpendicular to a direction extending from said head end of said patient support apparatus to said foot end of said patient support apparatus, said pivotable head section pivotable between a generally horizontal orientation and a raised orientation;

an actuator coupled to said frame and adapted to pivot said pivotable head section about said pivot axis, said actuator including an electrical motor;

a controller in electrical communication with said actuator;

a foot pedal coupled to said base and moveable between a first position and a second position;

an electrical link between said foot pedal and said controller, said electrical link adapted to communicate an activation signal to said controller when said foot pedal moves from said first position to said second position;

a mechanical link between said foot pedal and said actuator, said mechanical link adapted to communicate mechanical motion to said actuator when said foot pedal moves from said first position to said second position; and an angle sensor adapted to detect an angular orientation of said head section and to forward the detected angular orientation of said head section to said controller, said controller adapted to compare said angle to a predetermined angle upon receiving said activation signal and to utilize the comparison in lowering said head section.

2. The apparatus of claim 1 wherein said mechanical link is coupled to a release on said actuator and said communicating of said mechanical motion from said foot pedal to said actuator causes said release to be activated.

3. The apparatus of claim 2 wherein said actuator includes a variable length member and said electrical motor is adapted to cause changes in a length of said variable length member, said release adapted to allow changes in a length of said variable length member to occur at a rate faster than a rate dictated by said electrical motor.

4. The apparatus of claim 3 wherein said actuator pivots said head section upwardly toward said raised orientation when said variable length member expands its length, and said actuator pivots said head section downwardly toward said generally horizontal orientation when said variable length member contracts its length.

5. The apparatus of claim 4 wherein said mechanical link includes a Bowden cable coupled between said foot pedal and said actuator.

6. The apparatus of claim 3 further including a user interface separate from said foot pedal, said user interface including a first user-activated control that causes said actuator to raise said head section toward said raised orientation, and said user interface including a second user-activated control that causes said actuator to lower said head section toward said generally horizontal orientation.

7. The apparatus of claim 6 wherein said second user-activated control causes said actuator to lower said head section at a rate dictated by a speed of said motor.

8. The apparatus of claim 7 wherein said mechanical link is coupled to a release on said actuator and said communicating of said mechanical motion from said foot pedal to said actuator causes said release to be activated, said activation of said release allowing said head section to be lowered at a rate faster than said rate dictated by said speed of said motor.

9. The apparatus of claim 8 wherein said user interface is coupled to one of a siderail, a headrail, a footrail, and said frame of said patient support apparatus.

10. The apparatus of claim 1 wherein said controller determines if said angular orientation of said head section exceeds said predetermined angle and, if said angular orientation of said head section does exceed said predetermined angle, said controller sends a control signal activating said motor such that said actuator urges said head section to pivot downwardly toward said generally horizontal orientation, and if said angular orientation of said head section does not exceed said predetermined angle, said controller does not activate said motor.

11. The apparatus of claim 10 wherein said predetermined angle is between ten and ninety degrees.

12. A patient support apparatus comprising:

a patient support deck adapted to support a patient and having a head end and a foot end, said patient support deck including a pivotable head section adapted to pivot about a horizontal pivot axis oriented generally perpendicular to a direction extending from said head end to said foot end, said pivotable head section pivotable between a generally horizontal orientation and a raised orientation;

an actuator adapted to pivot said pivotable head section about said pivot axis, said actuator including a motor;

a sensor adapted to detect an angular orientation of said head section with respect to a known reference;

a first user-activated control adapted to drive said motor such that said head section pivots toward said generally horizontal orientation at a first rate dictated by a speed of said motor;

a second user-activated control adapted to allow said head section to pivot from an initial orientation toward said generally horizontal orientation at a second rate faster than said first rate dictated by said speed of said motor; and a controller in communication with said sensor and adapted to drive said motor, said second user-activated control causing said controller to drive said motor only if said sensor detects said angular orientation of said head section is greater than a predetermined threshold.

13. The apparatus of claim 12 wherein said predetermined threshold is between fifteen and seventy degrees.

14. The apparatus of claim 12 wherein said second user-activated control includes a foot pedal coupled to a base of said patient support apparatus.

15. The apparatus of claim 14 wherein said foot pedal, when pressed, activates a mechanical link to said actuator and an electrical link to said controller.

16. The apparatus of claim 15 wherein said first user-activated control is mounted to one of a frame, a siderail, a headrail, and a footrail of said patient support apparatus.

17. An emergency drop assembly for a patient support apparatus adapted to pivot a head section of a patient support deck about a pivot axis from an initial non-horizontal orientation to a generally horizontal orientation, said drop assembly comprising:

a sensor adapted to detect an angular orientation of said head section with respect to a known reference;

an actuator adapted to pivot said pivotable head section about said pivot axis, said actuator including a motor;

a user-activated control adapted to be activated by a user; and a controller in communication with said sensor, said motor, and said user-activated control, said controller adapted to allow the pivoting of said head section from the initial non-horizontal orientation to the generally horizontal orientation in a first manner if the angular orientation detected by said sensor meets a first criteria and in a second manner if the angular orientation detected by said sensor does not meet said first criteria, said first manner being different from said second manner.

18. The assembly of claim 17 wherein said first criteria is an angle having a value greater than ten degrees.

19. The assembly of claim 18 wherein:

said actuator includes a variable length member and said motor is adapted to cause changes in a length of said variable length member when said motor is driven; and said first manner includes running said motor while simultaneously activating a release on said actuator, said release adapted to allow said actuator to allow changes in a length of said variable length member to occur at a rate faster than a rate dictated by said electrical motor.

20. The assembly of claim 19 wherein said user-activated control includes a foot pedal mounted to a base of the patient support apparatus.

21. The assembly of claim 20 wherein said foot pedal, when pressed, activates a mechanical link to said actuator and an electrical link to said controller.

22. The assembly of claim 21 wherein said mechanical link includes a Bowden cable.

23. The assembly of claim 22 wherein said second manner includes not driving said motor.

24. The assembly of claim 17 wherein said user-activated control activates a mechanical link to a release on said actuator, said release on said actuator allowing said head section to pivot to said generally horizontal orientation even in the absence of electrical power supplied to said motor or said sensor.

25. The assembly of claim 24 wherein said user-activated control includes a pair of foot pedals mounted to opposite sides of said base and a rotatable shaft coupled to each of said foot pedals in said pair, said rotatable shaft transferring any motion of a first one of said pair of foot pedals to a second one of said pair of foot pedals.

26. The assembly of claim 25 wherein said user-activated control further includes an electrical sensor in communication with said controller and coupled to said base, and a crank arm coupled between each foot pedal and said rotatable shaft, at least one of said crank arms dimensioned to activate said electrical sensor when said shaft is rotated such that said sensor transmits an electrical signal to said controller when either of said pedals are pressed.

27. The assembly of claim 17 wherein said known reference is one of a horizontal plane and a component of said frame.

28. The assembly of claim 17 further including a spring configured to urge said head section toward the generally horizontal orientation only when the angular orientation of said head section exceeds a predetermined threshold.

29. The assembly of claim 28 wherein said first criteria is an angle having a value greater than a threshold value and said threshold value is the same as said predetermined threshold.

* * * * *

UNITED STATES PATENT AND TRADEMARK OFFICE

CERTIFICATE OF CORRECTION

PATENT NO. : 7,836,531 B2
APPLICATION NO. : 12/184740
DATED : November 23, 2010
INVENTOR(S) : Girard et al.

It is certified that error appears in the above-identified patent and that said Letters Patent is hereby corrected as shown below:

Column 11
Line 11, “bead” should be --head--

Signed and Sealed this
Fifteenth Day of March, 2011

David J. Kappos

David J. Kappos
*Director of the United States Patent and Trademark Office*